US007159562B2

(12) United States Patent
Asakage

(10) Patent No.: US 7,159,562 B2
(45) Date of Patent: Jan. 9, 2007

(54) ENGINE CONTROL DEVICE FOR CONSTRUCTION MACHINE

(75) Inventor: Tomohiko Asakage, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 10/542,245

(22) PCT Filed: Jan. 28, 2004

(86) PCT No.: PCT/JP2004/000772

§ 371 (c)(1),
(2), (4) Date: Jul. 15, 2005

(87) PCT Pub. No.: WO2004/070186

PCT Pub. Date: Aug. 19, 2004

(65) Prior Publication Data

US 2006/0118084 A1 Jun. 8, 2006

(30) Foreign Application Priority Data

Feb. 10, 2003 (JP) ..... 2003-032348

(51) Int. Cl.
*F02D 17/04* (2006.01)

(52) U.S. Cl. ..... 123/397

(58) Field of Classification Search ..... None
See application file for complete search history.

(56) References Cited

U.S. PATENT DOCUMENTS

2006/0144669 A1* 7/2006 Asakage et al. ..... 192/129 R

FOREIGN PATENT DOCUMENTS

| | | |
|---|---|---|
| JP | 59-032524 | 2/1984 |
| JP | 61-4838 | 1/1986 |
| JP | 09-049446 | 2/1997 |
| JP | 2000-096627 | 4/2000 |
| JP | 2000-248975 | 9/2000 |
| JP | 2001-041069 | 2/2001 |
| JP | 2002-013425 | 1/2002 |

* cited by examiner

*Primary Examiner*—Andrew M. Dolinar
(74) *Attorney, Agent, or Firm*—Oblon, Spivak, McClelland, Maier & Neustadt, P.C.

(57) ABSTRACT

A engine control device for a construction machine of the present invention is configured so that the engine control device comprises a first switch for selecting effectiveness/ineffectiveness of an automatic deceleration control by a controller and a second switch for selecting effectiveness/ineffectiveness of an automatic stop control, and that when a predetermined automatic stop condition is met even if the ineffectiveness of the automatic deceleration control is selected by the controller, the automatic deceleration control which reduces an engine speed is caused to be operated for a fixed period prior to the automatic stop control.

2 Claims, 3 Drawing Sheets

ENGINE CONTROL DEVICE FOR CONSTRUCTION MACHINE

TECHNICAL FIELD

The present invention relates to an engine control device for a construction machine in which an engine is automatically stopped (automatic stop) at a non-operation time.

BACKGROUND ART

A construction machine including an automatic stop function for automatically stopping an engine when predetermined automatic stop conditions (for example, a gate lever for opening and closing a gateway to a cabin is opened and an operating lever for operating a work actuator is in non-operation) are met has been disclosed in Japanese Patent Laid-Open Nos. 2000-96627 and 2001-41069.

Further, a technique in which when fixed conditions are met (for example, an operating lever for operating a work actuator is not continuously operated for a fixed period) a speed of an engine is automatically reduced to save fuel or the like, so called an automatic deceleration (automatic speed reduction) function is performed, has been generally known.

In a case where the above-mentioned automatic deceleration function is combined with the above-mentioned automatic stop function so that effectiveness/ineffectiveness of both functions can be selected, when automatic stop conditions are met while ineffectiveness of the automatic deceleration function is selected using the automatic stop function, a situation in which the only automatic stop function serves so that an engine is stopped while keeping high engine speed, is generated. Accordingly, the engine and other devices cannot be protected.

It is an object of the present invention to provide an engine control device for a construction machine, which can reliably protect an engine and other devices even in a state where the ineffectiveness of the automatic deceleration function is selected.

DISCLOSURE OF THE INVENTION

To solve the above-mentioned problems, the present invention adopted the following configurations.

The present invention is configured so that it comprises an engine as a power source, control means for performing an automatic deceleration control adapted to reduce a rotational number of the engine when a predetermined automatic deceleration condition is met, and an automatic stop control adapted to automatically stop the engine when a predetermined automatic stop condition is met, and selection means adapted to switch between an automatic deceleration effective position adapted to make the automatic deceleration control by the control means effective and an automatic deceleration ineffective position adapted to make the automatic deceleration control ineffective, and when the automatic stop condition is met even if the selection means is set at the automatic deceleration ineffective position, the control means performs a forced control adapted to cause the automatic deceleration control to be operated for a fixed period prior to the automatic stop control.

Further, the present invention is configured so that it comprises an engine as a power source, control means for performing an automatic deceleration control adapted to reduce a rotational number of the engine when a predetermined automatic deceleration condition is met, and an automatic stop control adapted to automatically stop the engine when a predetermined automatic stop condition is met, and selection means adapted to select one of a predetermined first state to a predetermined third state with regard to effectiveness and ineffectiveness of the automatic deceleration control and the automatic stop control by the control means, and the control means is adapted to make both the automatic deceleration control and the automatic stop control effective when the first state is selected by the selection means, to make only the automatic deceleration control effective when the second state is selected, to make both the automatic deceleration control and the automatic stop control ineffective when the third state is selected, and to perform a forced control adapted to cause the automatic deceleration control to be operated for a fixed period prior to the automatic stop control when the automatic stop condition is met in a state where the first state is selected.

BEST MODE FOR CARRYING OUT THE INVENTION

Figure 1:
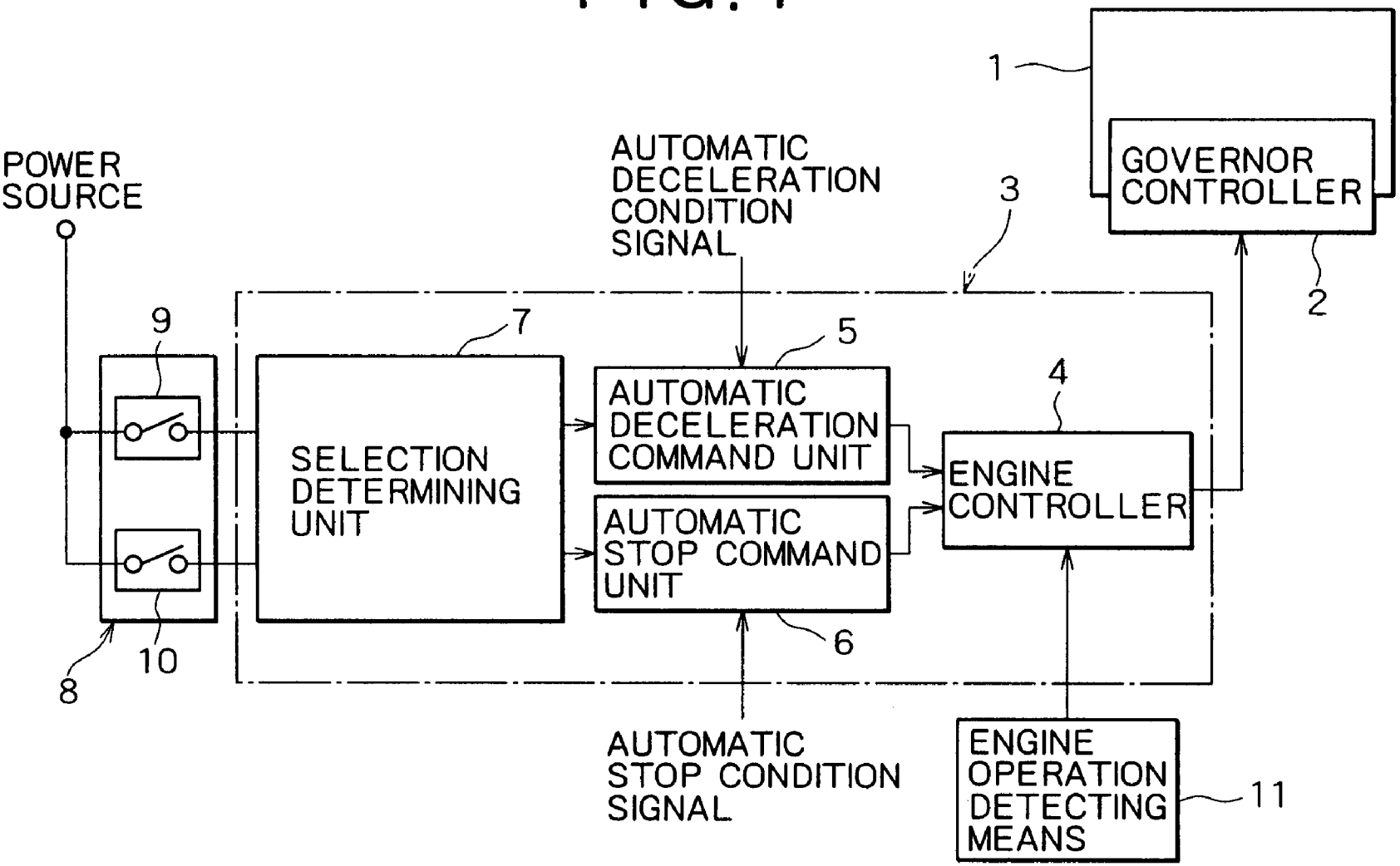
FIG. 1 is a block diagram showing a first embodiment of the present invention.
Figure 2:
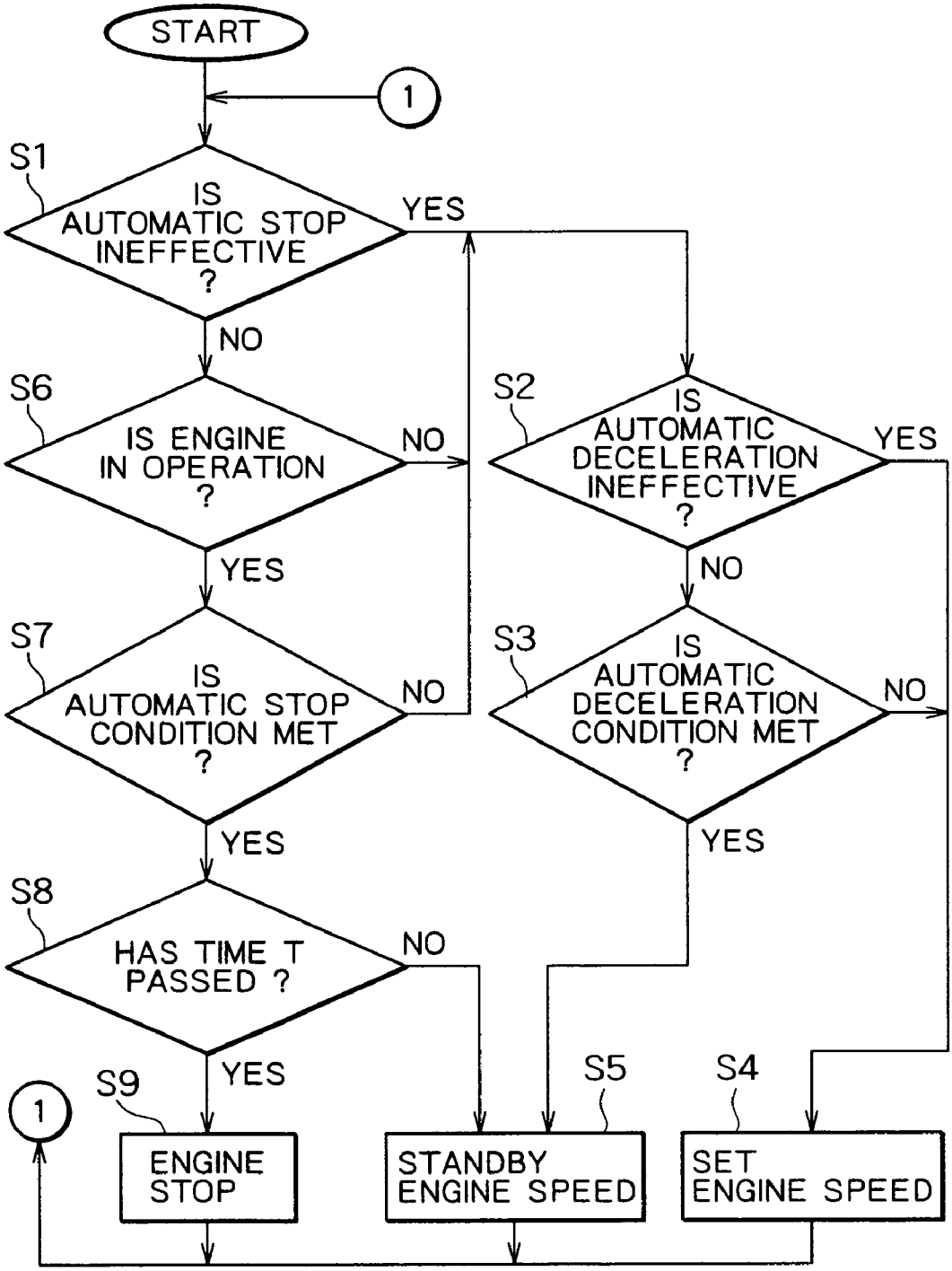
FIG. 2 is a flow chart for explaining an action of the first embodiment.

First Embodiment (See FIGS. 1 and 2)

Reference numeral 1 denotes an engine as a power source. This engine 1 is provided with a governor controller 2. By this governor controller 2, a control of stop/speed (rotational number or number of rotation) of the engine 1 is performed based on signals from a controller 3 as control means and an engine throttle (speed setter).

The controller 3 includes an engine controller 4, which sends signals of commands of stop/speed to the governor controller 2, an automatic deceleration command unit 5, which sends a command of starting an automatic deceleration control for reducing an engine speed to a low speed of a predetermined value or less so that cooling down of the engine is performed to this engine controller 4, an automatic stop command unit 6, which sends a command of starting an automatic stop control to the engine controller 4 and a selection determining unit 7.

The selection determining unit 7 determines effectiveness/ineffectiveness of the automatic deceleration control and the automatic stop control based on the ON/OFF operation of both first and second switches 9 and 10, which constitute selection means 8. This determination condition is as follows.

When the first switch 9 is turned ON, it is determined that the effectiveness of the automatic deceleration control is selected, and when the switch is turned OFF it is determined that the ineffectiveness of the automatic deceleration control is selected.

When the first switch 10 is turned ON, it is determined that the effectiveness of the automatic stop control is selected and when the switch is turned OFF it is determined that the ineffectiveness of the automatic stop control is selected.

These determination results are sent to the automatic deceleration command unit 5 and the automatic stop command unit 6.

Further to the automatic deceleration command unit 5 is input a signal (automatic deceleration condition signal), which shows that a predetermined starting condition of automatic deceleration control is met, and to the automatic stop command unit 6 is input a signal (automatic stop condition signal), which shows that a predetermined starting condition of automatic stop control is set. A signal for commanding the start of a control (automatic deceleration or automatic stop control) determined to be effective is sent from both command units 5 and 6 to the engine controller 4 based on the condition signal and the determination signal from the above-mentioned selection determining unit 7.

It is noted that the automatic deceleration condition includes for example a condition in which a remote control valve (not shown), which controls an operation of a working hydraulic actuator is not continuously operated for a fixed period (non-operation). This condition is detected by a pressure sensor provided in the remote control valve and sent to the automatic deceleration command unit 5.

On the other hand, the automatic stop condition includes for example a condition in which a gate lever for opening and closing a gateway of a cabin is opened. This condition is detected by a switch, which is ON/OFF operated in synchronization with a movement of the gate lever and sent to the automatic stop command unit 6.

It is noted that when a machine of a canopy structure having no cabin has alternative means for the above-mentioned gate lever, the operation of this alternative means becomes an automatic stop condition. For example, when an operating lever box provided with an operating lever is liftable and lowerable and the machine has a configuration in which the lever box is lowered at the seating of an operator, a condition in which the operating lever box is lifted (opened) becomes an automatic stop condition.

Further, to the engine controller 4 is sent a signal from engine operation detecting means 11 in addition to command signals from both command units 5 and 6.

As the engine operation detecting means 11 a sensor for detecting a speed of the engine 1, a sensor for detecting voltage or current of a generator driven by the engine 1, and a sensor for detecting a pressure of a hydraulic pump as an actuator driving source are used. The automatic deceleration or automatic stop control is performed on the premise that it is detected that the engine 1 is in operation by the engine operation detecting means 11.

An action of this controller 3 will be explained by way of a flow chart of FIG. 2.

It is determined whether the automatic stop control is ineffective or not at the starting of control (Step S1). If it is determined to be ineffective, the processing flow advances to Step S2, and if it is determined to be effective the processing flow advances to Step S6.

In Step S2, it is further determined whether the automatic deceleration control is effective or ineffective. If it is determined to be NO (effective), it is determined whether or not the automatic deceleration is met in Step S3.

In a case of NO (not met) in Step S3, and in a case of YES (ineffective) in Step S2, the engine speed is maintained to a speed (predetermined speed) set by an engine throttle in Step S4. In the meanwhile, in a case of YES (automatic deceleration condition is met) in Step S3, the engine speed is reduced to a predetermined low standby speed in Step S5.

On the other hand, in a case of NO (automatic stop control is effective) in Step S1, it is determined whether or not the engine is in operation in Step S6, and whether or not the automatic stop condition is met in Step S7. In a case of NO in Steps S6 and S7, the processing flow returns to Step S2.

On the contrary, in a case of YES in Step S7, the processing flow advances to Step S8 so that it is determined whether or not a predetermined period T as a period required for cooling down has passed. In a case of NO (prior to the passage of period T) in Step S8, the engine speed is maintained to the standby speed (Step S5) and after the passage the engine 1 is automatically stopped (Step S9).

Further, in a case of YES (the passage of period T) in Step S8, the processing flow advances to Step S9 so that the engine 1 is automatically stopped.

As described above, the effectiveness/ineffectiveness of automatic deceleration control is selected by selection means 8. In a state where the automatic stop condition is not met, the automatic deceleration control is operated in accordance with this selection, or it becomes ineffective.

On the other hand, if the automatic stop condition is met in Step S7, an automatic deceleration control (forced control) is performed by Steps S8 and S5 prior to the automatic stop control within a fixed period T irrespective of the selection of effectiveness/ineffectiveness of the automatic deceleration control, and the engine speed is reduced so that cooling down of the engine 1 is carried out. Accordingly, there is no fear that the engine 1 is suddenly stopped with high speed more than a predetermined value, thereby leading to a breakdown of devices such as the engine 1 and the like. Namely, this engine control device can ensure protective action on devices, which is the predetermined object of the device.

Figure 3:
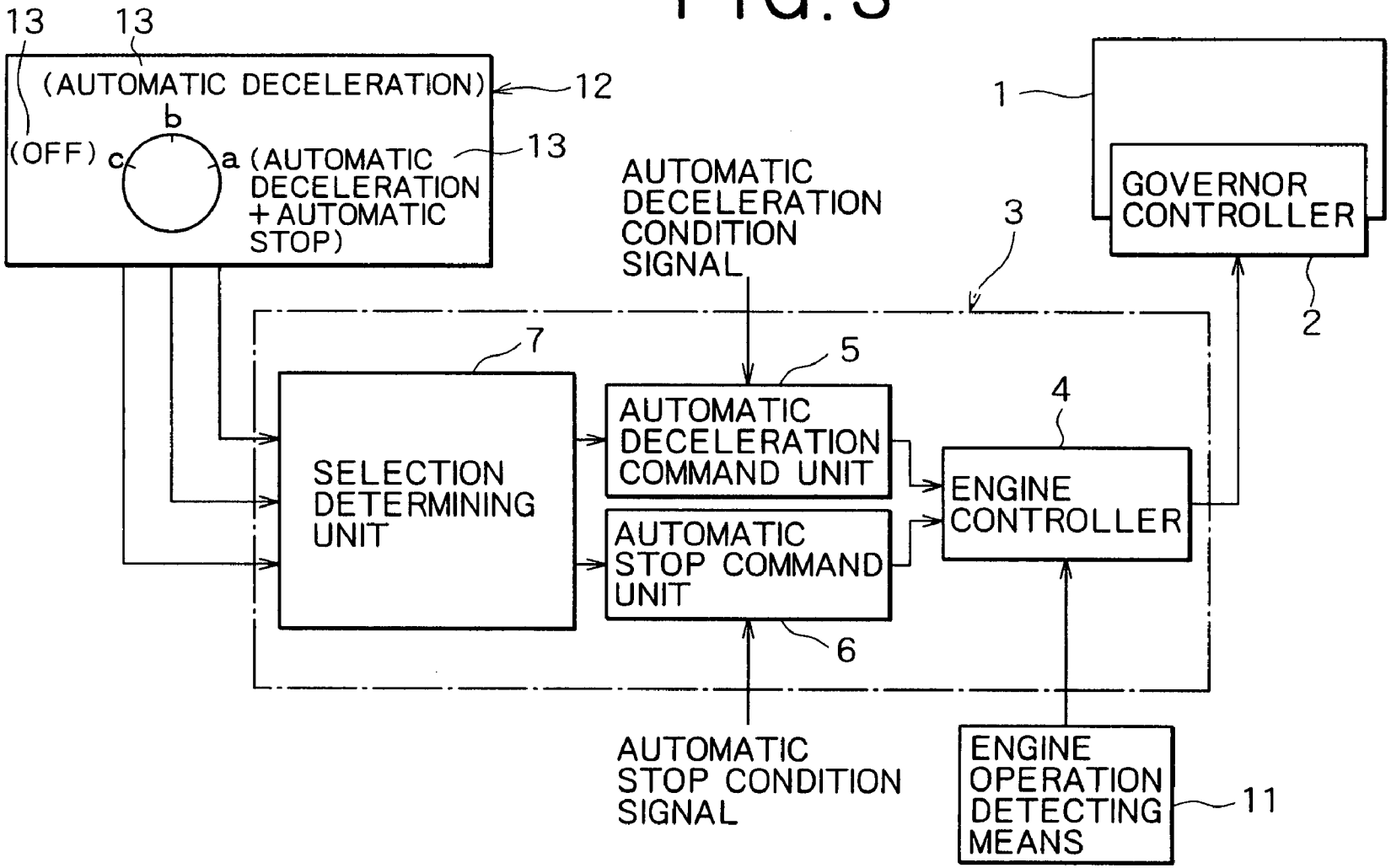
FIG. 3 is a block diagram showing a second embodiment of the present invention.

Second Embodiment (See FIG. 3)

Only different points from first embodiment will be described.

In the first embodiment, even in a state where an operator turned OFF the first switch 9 of the selection means 8 so that the automatic deceleration control is made ineffective, if the automatic stop condition is met, the automatic deceleration control forcibly is operated prior to automatic stop. Thus, when an operator does not understand this mechanism, the device is shifted to an operation state, which is against the operator's intention to make the automatic deceleration ineffective, and the operator can misunderstand that the device is in trouble.

Thus, in the second embodiment, as selection means a rotary selection switch 12 is used. A first position (first state) (a), where both automatic deceleration control and automatic stop control become effective, a second position (second state) (b), where only the automatic deceleration control becomes effective, and a third position (third state) (c), where both the automatic deceleration control and the automatic stop control become ineffective are set in the switch 12. To the respective positions (a), (b) and (c) are provided with indications 13 indicating respective selection items (for example, as shown in FIG. 3, characters of "automatic deceleration+automatic stop" at the first position (a), "automatic deceleration" at the second position (b), and "OFF" at the third position (c)).

This configuration does not produce a state where only the automatic stop control becomes effective as a selection state by the selection switch 12. In other word, the effectiveness/ineffectiveness of automatic stop control cannot singly be selected and has to be selected only in pairs with the automatic deceleration control.

Thus, when the automatic stop control is operated the operator finds that the automatic deceleration control is also operated and then selection is effected. Therefore, even if the automatic deceleration control is operated prior to the automatic stop the operator cannot misunderstand the state as a trouble.

Further, since the automatic deceleration control is always operated prior to the automatic stop control as in the first embodiment, a predetermined object to protect devices such as an engine can be reliably attained.

Other Embodiments (1) An automatic deceleration control period T prior to an automatic stop control may be controlled to be long or short period for every machine in accordance with operator's preference, work environment or the like.

(2) Such a configuration that a standby speed before an engine is stopped by the automatic stop control and a standby speed by the automatic deceleration control may be differentiated from each other.

(3) As a variation of the second embodiment, rotation type selection means which sequentially switches between the respective first to third states by repeated operation of one switch may be adopted. In this case, it is desirable that the switched state is indicated by turning on, blinking or turning off of a lamp or the like.

(4) In the automatic stop control, a power source of a machine may be shut off at the same time or in a fixed period after the engine is stopped.

(5) Serving conditions of action of the automatic stop control can appropriately be changed in accordance with use environment of the machine or the like.

INDUSTRIAL APPLICABILITY

According to the present invention as described above, when an automatic stop condition is met, an automatic deceleration control (forced control) is performed prior to an automatic stop control for a fixed period irrespective of a selection of effectiveness/ineffectiveness of the automatic deceleration so that an engine speed is reduced. Thus, a protection action of devices such as an engine and the like can be ensured.

Further, according to the present invention, as a selection state by selection means there is no state where only the automatic stop control becomes effective and effectiveness/ineffectiveness of the automatic stop control can be selected only in pairs with the automatic deceleration control. Thus, at the automatic stop, the selection is effected after the operator recognized that the automatic deceleration control is operated. Therefore, even if the automatic deceleration control is operated prior to automatic stop, the operator cannot misunderstand it as a trouble.

What is claimed is:

1. An engine control device for a construction machine, characterized in that said engine control device comprises an engine as a power source, control means for performing an automatic deceleration control adapted to reduce a rotational number of said engine when a predetermined automatic deceleration condition is met, and an automatic stop control adapted to automatically stop said engine when a predetermined automatic stop condition is met, and selection means adapted to switch between an automatic deceleration effective position adapted to make said automatic deceleration control by said control means effective and an automatic deceleration ineffective position adapted to make said automatic deceleration control ineffective, and wherein when said automatic stop condition is met even if said selection means is set to said automatic deceleration ineffective position, said control means performs a forced control adapted to cause said automatic deceleration control to be operated for a fixed period prior to said automatic stop control.

2. An engine control device for a construction machine, characterized in that said engine control device comprises an engine as a power source, control means for performing an automatic deceleration control adapted to reduce a rotational number of said engine when a predetermined automatic deceleration condition is met, and an automatic stop control adapted to automatically stop said engine when a predetermined automatic stop condition is met, and selection means adapted to select one of a predetermined first state to a predetermined third state with regard to effectiveness and ineffectiveness of said automatic deceleration control and the automatic stop control by said control means, and wherein said control means is adapted to make both said automatic deceleration control and said automatic stop control effective when said first state is selected by said selection means, to make only said automatic deceleration control effective when said second state is selected, to make both said automatic deceleration control and said automatic stop control ineffective when said third state is selected, and to perform a forced control adapted to cause said automatic deceleration control to be operated for a fixed period prior to said automatic stop control when said automatic stop condition is met in a state where said first state is selected.

* * * * *